US007854333B2

(12) United States Patent
Kottke et al.

(10) Patent No.: US 7,854,333 B2
(45) Date of Patent: Dec. 21, 2010

(54) REAR LOADING GATE FOR MERCHANDISING SYSTEM

(75) Inventors: Fredrick L. Kottke, Menomonee Falls, WI (US); Allen Johnson, Hartford, WI (US)

(73) Assignee: DCI Marketing, Inc., Milwaukee, WI (US)

( * ) Notice: Subject to any disclaimer, the term of this patent is extended or adjusted under 35 U.S.C. 154(b) by 444 days.

(21) Appl. No.: 12/116,918

(22) Filed: May 7, 2008

(65) Prior Publication Data

US 2009/0277924 A1 Nov. 12, 2009

(51) Int. Cl.
*A47F 1/04* (2006.01)

(52) U.S. Cl. ..... 211/59.2

(58) Field of Classification Search ..... 211/59.2, 211/59.3, 183, 184, 175, 126.1, 168; 24/457, 24/297; 16/86.1, 221, 231, 232, 277, 289, 16/298

See application file for complete search history.

(56) References Cited

U.S. PATENT DOCUMENTS

| | | | |
|---|---|---|---|
| 870,993 | A | 11/1907 | Richardson |
| 903,368 | A | 11/1908 | Flanders |
| 1,030,317 | A | 6/1912 | Middaugh |
| 1,117,255 | A | 11/1914 | Schmidt |
| 1,750,575 | A | 3/1930 | Cubberley |
| 2,079,754 | A | 5/1937 | Waxgiser |
| 2,110,299 | A | 3/1938 | Hinkle |
| 2,303,275 | A | 11/1942 | Hull |
| 2,625,162 | A | 1/1953 | Edeborg |
| 2,652,154 | A | 9/1953 | Stevens |
| 3,161,295 | A | 12/1964 | Chesley |
| 3,308,961 | A | 3/1967 | Chesley |
| 3,348,732 | A | 10/1967 | Schwarz |
| 3,452,899 | A | 7/1969 | Libberton |
| 3,893,585 | A | 7/1975 | Morrison et al. |
| 4,130,203 | A | 12/1978 | Russell, III |
| 4,300,693 | A | 11/1981 | Spamer |
| 4,330,955 | A | 5/1982 | Rabas |
| 4,337,588 | A | 7/1982 | Clapper |
| 4,378,872 | A | 4/1983 | Brown |
| 4,401,323 | A | 8/1983 | Rex |
| 4,438,993 | A | 3/1984 | Rabas |
| D277,154 | S | 1/1985 | Nasgowitz |
| 4,496,127 | A | 1/1985 | Nelson |
| 4,598,838 | A | 7/1986 | Zakrajsek |
| 4,600,121 | A | 7/1986 | Falk et al. |
| 4,625,894 | A | 12/1986 | James et al. |
| 4,632,412 | A | 12/1986 | Nasgowitz |

(Continued)

*Primary Examiner*—Jennifer E. Novosad
(74) *Attorney, Agent, or Firm*—Brian G. Gilpin; Godfrey & Kahn, S.C.

(57) ABSTRACT

A merchandising and product display system includes a space defined between a pair of generally parallel dividers. At a rear end of each divider, a rear loading gate is mounted to permit product containers to be inserted through the rear into the opening and to prevent products from being pushed from within the space through the rear of the space. The loading gate includes a pair of wings extending less than halfway across the width of the opening. The wings are hingedly mounted to a central portion permitting the wing to be deflected forward and rearward, and include a rearward extending bulkhead that engages the central portion. The engagement of the bulkhead and the central portion prevents the wings from being deflected sufficiently to permit a product container from passing the gate.

12 Claims, 11 Drawing Sheets

U.S. PATENT DOCUMENTS

| | | | |
|---|---|---|---|
| 4,640,029 | A | 2/1987 | Hornblad et al. |
| D289,458 | S | 4/1987 | Zakrajsek |
| 4,663,872 | A | 5/1987 | Finger |
| 4,685,574 | A | 8/1987 | Young et al. |
| D293,984 | S | 2/1988 | Finger |
| 4,724,968 | A | 2/1988 | Wombacher |
| 4,730,741 | A | 3/1988 | Jackle, III et al. |
| 4,759,470 | A | 7/1988 | Jacobs |
| 4,762,236 | A | 8/1988 | Jackle, III et al. |
| 4,807,779 | A | 2/1989 | Clapper |
| 4,830,201 | A | 5/1989 | Breslow |
| 4,836,390 | A | 6/1989 | Polvere |
| 4,856,659 | A | 8/1989 | Krebs |
| 4,874,099 | A | 10/1989 | Arnott et al. |
| 4,901,869 | A | 2/1990 | Hawkinson et al. |
| 4,934,645 | A | 6/1990 | Breslow |
| 4,937,962 | A | 7/1990 | Hornblad |
| 4,948,004 | A | 8/1990 | Chich |
| 5,012,936 | A | 5/1991 | Crum |
| 5,038,970 | A | 8/1991 | Chich |
| 5,069,349 | A | 12/1991 | Wear et al. |
| 5,097,962 | A | 3/1992 | Eklof et al. |
| 5,114,021 | A | 5/1992 | Fredrickson |
| 5,123,546 | A | 6/1992 | Crum |
| 5,161,702 | A | 11/1992 | Skalski |
| 5,190,186 | A | 3/1993 | Yablans et al. |
| 5,199,584 | A | 4/1993 | Fowler et al. |
| 5,220,739 | A | 6/1993 | Chich et al. |
| 5,222,608 | A | 6/1993 | Eklof |
| 5,240,126 | A | 8/1993 | Foster et al. |
| 5,255,802 | A | 10/1993 | Krinke et al. |
| 5,265,738 | A | 11/1993 | Yablans et al. |
| 5,295,593 | A | 3/1994 | Sturm |
| 5,366,099 | A | 11/1994 | Schmid |
| 5,368,191 | A | 11/1994 | Johnson |
| 5,412,547 | A | 5/1995 | Hornblad et al. |
| 5,413,229 | A | 5/1995 | Zuberbuhler et al. |
| 5,435,463 | A | 7/1995 | Hodgson |
| 5,450,969 | A | 9/1995 | Johnson et al. |
| 5,469,976 | A | 11/1995 | Burchell |
| 5,485,929 | A | 1/1996 | Danon |
| 5,490,600 | A | 2/1996 | Bustos |
| 5,542,552 | A | 8/1996 | Yablans et al. |
| 5,547,306 | A | 8/1996 | Zakrajsek |
| 5,577,623 | A | 11/1996 | Bustos |
| 5,581,852 | A | 12/1996 | Zakrajsek |
| 5,593,048 | A | 1/1997 | Johnson |
| 5,634,564 | A | 6/1997 | Spamer et al. |
| 5,638,963 | A | 6/1997 | Finnelly et al. |
| 5,665,304 | A | 9/1997 | Heinen et al. |
| 5,671,851 | A | 9/1997 | Johnson et al. |
| 5,673,801 | A | 10/1997 | Markson |
| 5,685,664 | A | 11/1997 | Parham et al. |
| 5,746,328 | A | 5/1998 | Beeler et al. |
| 5,769,248 | A | 6/1998 | Johnson |
| 5,788,091 | A | 8/1998 | Robertson et al. |
| 5,806,690 | A | 9/1998 | Johnson et al. |
| 5,829,580 | A | 11/1998 | Schroeter |
| 5,839,588 | A | 11/1998 | Hawkinson |
| 5,855,281 | A | 1/1999 | Rabas |
| 5,855,283 | A | 1/1999 | Johnson |
| 5,873,489 | A | 2/1999 | Ide et al. |
| 5,970,887 | A | 10/1999 | Hardy |
| 5,985,413 | A | 11/1999 | Boyle et al. |
| 5,992,652 | A | 11/1999 | Springs |
| 5,992,653 | A | 11/1999 | Anderson et al. |
| D418,971 | S | 1/2000 | Scungio |
| 6,041,720 | A | 3/2000 | Hardy |
| 6,082,558 | A | 7/2000 | Battaglia |
| 6,105,791 | A | 8/2000 | Chalson et al. |
| 6,129,218 | A | 10/2000 | Henry et al. |
| 6,131,748 | A | 10/2000 | Kawasaki et al. |
| 6,142,317 | A | 11/2000 | Merl |
| 6,155,437 | A | 12/2000 | Rassent |
| 6,158,598 | A | 12/2000 | Josefsson |
| 6,168,032 | B1 | 1/2001 | Merl |
| 6,193,079 | B1 | 2/2001 | Wiemer |
| 6,210,017 | B1 | 4/2001 | Miura et al. |
| 6,227,385 | B1 | 5/2001 | Nickerson |
| 6,273,281 | B1 | 8/2001 | Berglund |
| 6,290,077 | B2 | 9/2001 | Sosso |
| 6,311,852 | B1 | 11/2001 | Ireland |
| 6,357,606 | B1 | 3/2002 | Henry |
| D455,519 | S | 4/2002 | Luedecke et al. |
| 6,375,015 | B1 | 4/2002 | Wingate |
| 6,382,431 | B1 | 5/2002 | Burke |
| 6,401,942 | B1 | 6/2002 | Eckert |
| 6,409,028 | B2 | 6/2002 | Nickerson |
| 6,454,122 | B1 | 9/2002 | Luedecke |
| D463,728 | S | 10/2002 | Johnson |
| D463,880 | S | 10/2002 | Luedecke et al. |
| D464,907 | S | 10/2002 | Jacobs |
| 6,464,089 | B1 | 10/2002 | Rankin, VI |
| 6,484,891 | B2 | 11/2002 | Burke |
| 6,523,703 | B1 | 2/2003 | Robertson |
| D473,076 | S | 4/2003 | Johnson |
| D474,923 | S | 5/2003 | Johnson |
| D476,170 | S | 6/2003 | Johnson |
| 6,571,498 | B1 | 6/2003 | Cyrluk |
| 6,585,120 | B2 | 7/2003 | Robertson |
| 6,622,874 | B1 | 9/2003 | Hawkinson |
| 6,666,533 | B1 | 12/2003 | Stavros |
| 6,691,891 | B2 | 2/2004 | Maldonado |
| 6,719,151 | B2 | 4/2004 | Close |
| 6,719,152 | B1 | 4/2004 | Nagel et al. |
| 6,749,168 | B2 | 6/2004 | Johnson |
| 6,823,997 | B2 | 11/2004 | Linden et al. |
| D499,453 | S | 12/2004 | Hornblad |
| D499,454 | S | 12/2004 | Hornblad |
| D499,768 | S | 12/2004 | Hornblad |
| 6,886,699 | B2 | 5/2005 | Johnson et al. |
| 6,905,039 | B2 | 6/2005 | Richter et al. |
| 6,986,918 | B2 | 1/2006 | Jacobs |
| 7,028,852 | B2 | 4/2006 | Johnson et al. |
| 7,032,766 | B2 | 4/2006 | Luedecke et al. |
| D520,776 | S | 5/2006 | Richter et al. |
| 2001/0010302 | A1 | 8/2001 | Nickerson |
| 2002/0108916 | A1 | 8/2002 | Nickerson |
| 2002/0179553 | A1 | 12/2002 | Squitieri |
| 2003/0057167 | A1 | 3/2003 | Johnson et al. |
| 2003/0061959 | A1 | 4/2003 | Johnson |
| 2003/0085187 | A1 | 5/2003 | Johnson et al. |
| 2003/0160060 | A1 | 8/2003 | Hornblad et al. |
| 2003/0217980 | A1 | 11/2003 | Johnson et al. |
| 2004/0079715 | A1 | 4/2004 | Richter et al. |
| 2004/0084392 | A1 | 5/2004 | Richter et al. |
| 2004/0222171 | A1 | 11/2004 | Johnson |
| 2005/0127014 | A1 | 6/2005 | Richter et al. |

REAR LOADING GATE FOR MERCHANDISING SYSTEM

BACKGROUND

The present invention relates generally to merchandising and display systems, and in particular, the present invention relates to a rear loading gate for a merchandising system providing for orderly presentation, display, storage, arrangement, and dispensing of articles.

With many conventional merchandising and product display systems, loading product into the system may be accomplished from either the front or the rear. However, when loading from the front, it is possible for product at the rear of the system to be pushed beyond the shelf or tray on which it is resting, resulting in the product possibly falling from the tray or shelf. Such a fall will likely render the product unsuitable for sale and may result in undesirable spoilage or waste. If access is limited to the rear of a system, any such fallen product that may rupture may also result in an unsanitary condition around the system.

It is therefore desirable to improve conventional merchandising systems to permit both front and rear loading but also provide for protection against fall of merchandise from the rear of the system when the system is front loaded.

SUMMARY

The present disclosure relates generally to an improved merchandising and product display system. More specifically, the present disclosure relates to a merchandising and product display system including a space defined between a pair of generally parallel dividers. At a rear end of each divider, a rear loading gate is mounted to permit product containers to be inserted through the rear into the opening and to prevent products from being pushed from within the space through the rear of the space. The loading gate includes a pair of wings extending across the opening. The wings are hingedly mounted to a central portion permitting the wing to be deflected forward and rearward, and include a rearward extending bulkhead that engages the central portion. The engagement of the bulkhead and the central portion prevents the wings from being deflected sufficiently in the rearward direction to permit a product container from passing the gate.

The present disclosure further relates to a rear loading gate for a merchandising system. The gate is configured with wings that extend generally laterally from a central portion and include a rearward extending bulkhead. The bulkhead engages the central portion when the wing is deflected rearward and the engagement prevents further rearward deflection.

BRIEF DESCRIPTION OF THE DRAWINGS

The accompanying drawing figures, which are incorporated in and constitute a part of the description, illustrate several aspects of the invention and together with the description, serve to explain the principles of the invention. A brief description of the figures is as follows.

DETAILED DESCRIPTION

Figure 1:
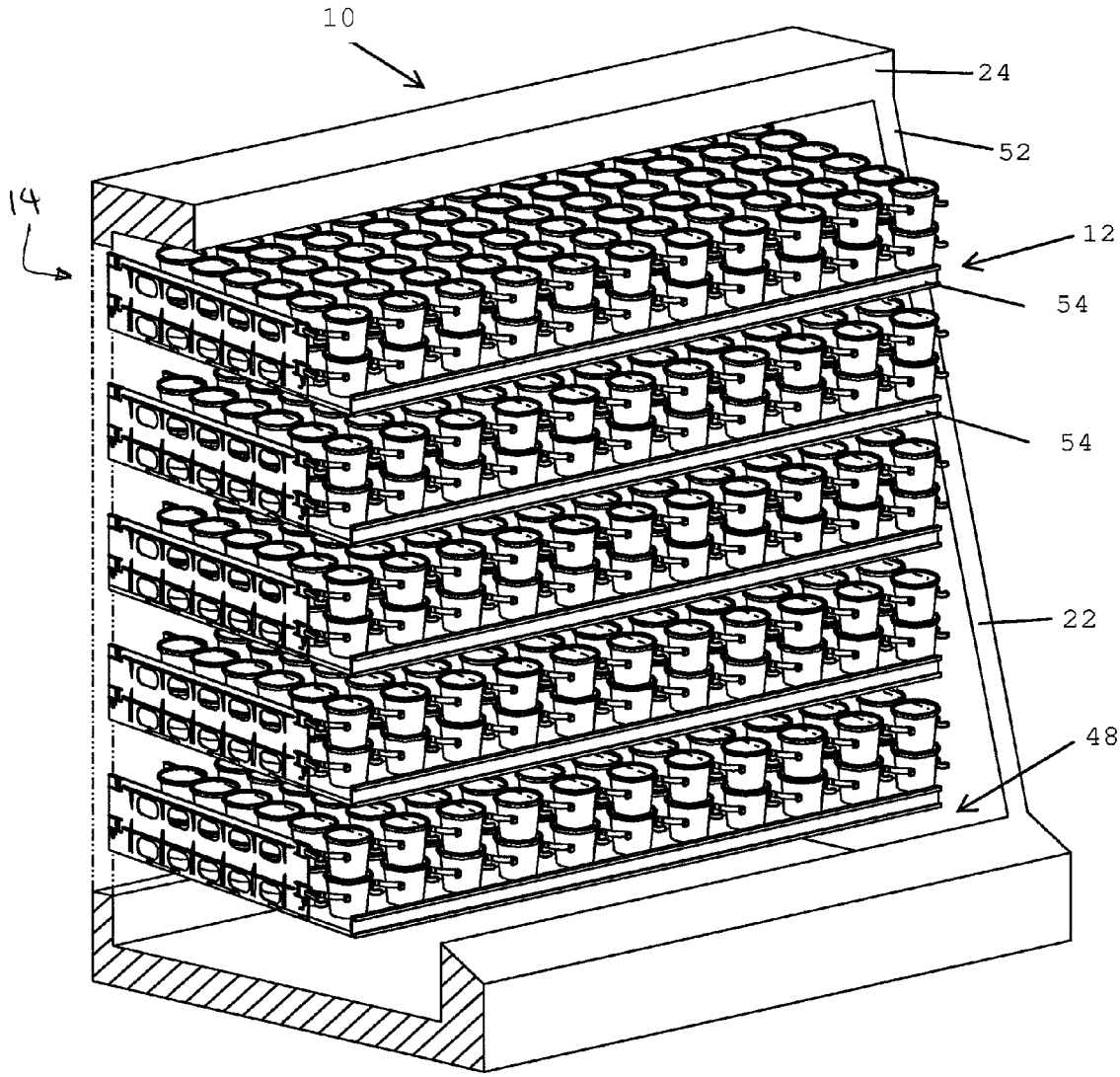
FIG. 1 is a front perspective view of a merchandising system according to an exemplary embodiment.

Reference will now be made in detail to exemplary aspects of the present invention which are illustrated in the accompanying drawings. Wherever possible, the same reference numbers will be used throughout the drawings to refer to the same or like parts.

It is to be understood that the invention is not limited to the details or methodology set forth in the following description or illustrated in the drawings. The invention is capable of other embodiments or being practiced or carried out in various ways. It is also to be understood that the phraseology and terminology employed is for the purpose of description and should not be regarded as limiting.

Referring to the FIGURES, exemplary embodiments of a merchandising system are shown. The merchandising system may provide for display, space division, and orderly presentation of products. The merchandising system may provide for selective size (shown as width) adjustment of a product display, "facing," cell, compartment, or display area, while not requiring the width adjustment of adjacent product displays, "facings," cells, compartments, or display areas. As shown in FIG. 1, a merchandising system 10 may provide a large number of facings. Should a single facing need to be adjusted (for example, to accommodate a differently sized product), that single facing may be readily adjusted without the need to resize any (or potentially all) of the remaining facings.

The merchandising system may further provide for modularity in the construction and assembly of the merchandising system. For example, product displays, "facings," cells, compartments, or display areas may be added and/or removed to an existing merchandising system by reconfiguring the number and arrangement of dividers and connectors.

The merchandising system may be a shelf system, shelf divider system, product facing tray system, product self-facing and organization tray system, divider system, shelf tray system, pusher system, dispensing system, tray system, etc. The merchandising system may be provided for use on a shelf (or any portion of a shelf), shelves, racks, displays, or other merchandising systems, or alternatively may be provided as a separate, independent merchandising system. According to other alternative embodiments, the system may be configured or oriented to provide for vertical size (e.g., height) adjustment.

According to an exemplary embodiment shown in FIG. 1, a merchandising system 10 (e.g., grid system, tray system, shelf system, display system, case, divider system, storage system, modular system, etc.) comprises a frame system 12 and a shelving system 14. Frame system 12 (e.g., mounting structure, shelving structure, support, framework, frame, base, bar, grid, housing, storage unit, etc.) comprises a storage unit 52 and a lower portion 48 or section. According to an exemplary embodiment, the system is a refrigerated system configured to display, store and/or dispense product. According to an exemplary embodiment, the system may be configured to contain products and/or containers for foodstuffs or the like, such as yogurt, to be displayed for customers.

Storage unit 52 comprises at least one side 22 and a top section 24 (e.g., top portion, section, overhead, roof, housing, cap, cover, etc.). The sides may be provided with one or more aperture and/or slot for providing an arrangement for positioning the shelving system with respect to the frame system. According to alternative embodiments, any suitable device and/or process may be used to secure the shelving system to the frame system. According to various alternative embodiments, a wide variety of storage units, shafts, supports, sides, covers, etc. may be provided in the merchandising system. According to alternative embodiments, the number, size, position, overall configuration, etc. of the storage unit may vary.

As shown in FIG. 1, shelving system 14 (e.g., frame, tray, shelf system, holder, mounting section or area, etc.) is provided for use with merchandising system 10. According to an exemplary embodiment shown in FIG. 1, shelving system 14 comprises a shelf 54.

Figure 2:
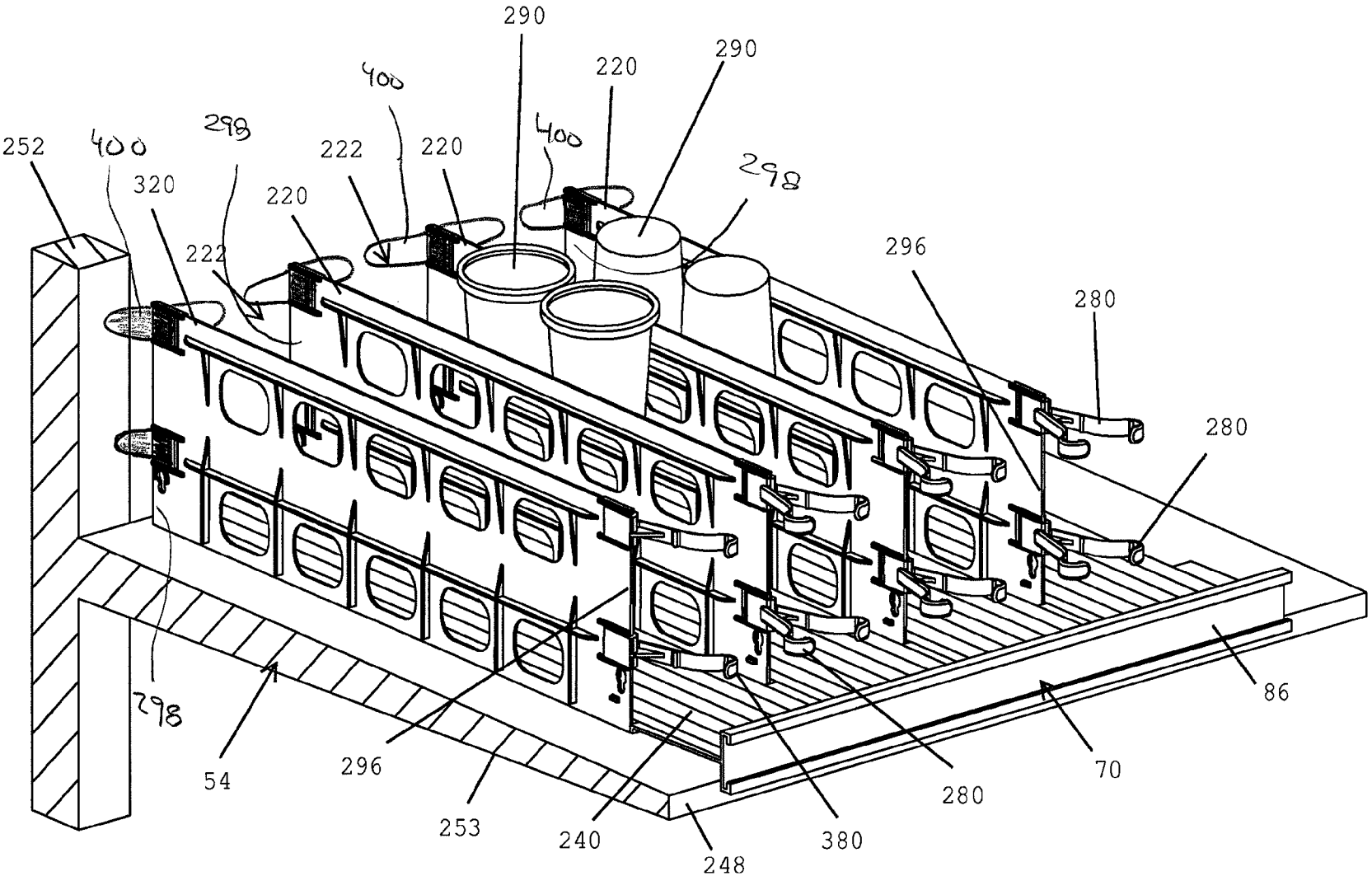
FIG. 2 is a perspective view of a shelf of the merchandising system of FIG. 1.

Referring now to FIG. 2, a portion of product shelf 54 is illustrated. Positioned on a shelf support 253, a plurality of dividers 220 and 320 cooperate with floors 240 to define a plurality product storage and display spaces 222. Floors 240 may also serve as connectors extending between adjacent dividers 220 and 320. As noted above, floor 240 is sloped downward from adjacent a rear shelf structure 252 toward a forward lip 248 of shelf support 253 to urge product containers 290 within the spaces 222 to slide forward as the forwardmost product containers are removed.

Figure 3:
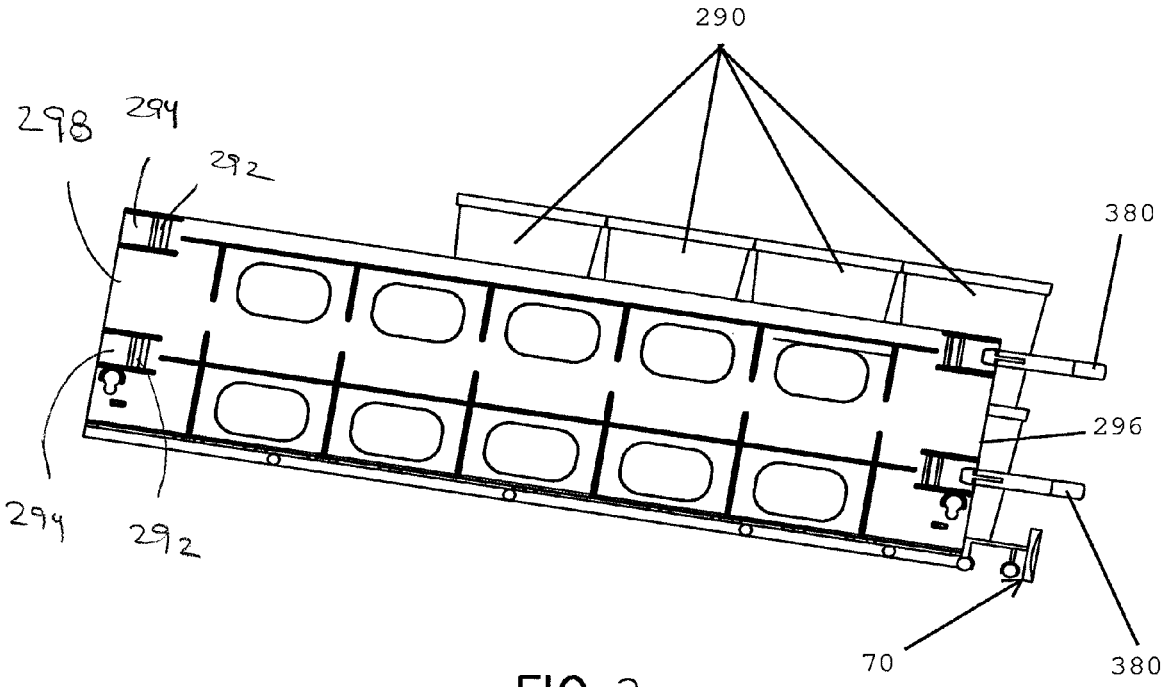
FIG. 3 is a side view of the product holding portion of the shelf of FIG. 2.
Figure 4:
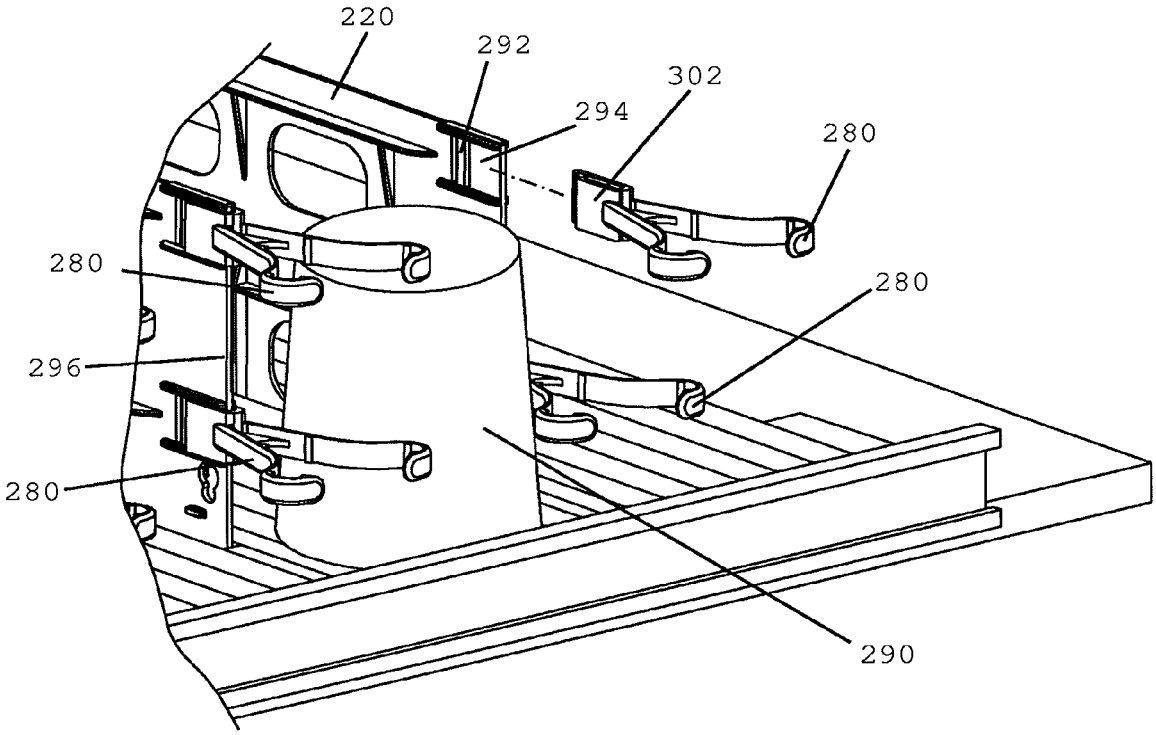
FIG. 4 is a detail front perspective view of a portion of the shelf portion of FIG. 3 with one front product retaining member exploded from its mounting position.
Figure 5:
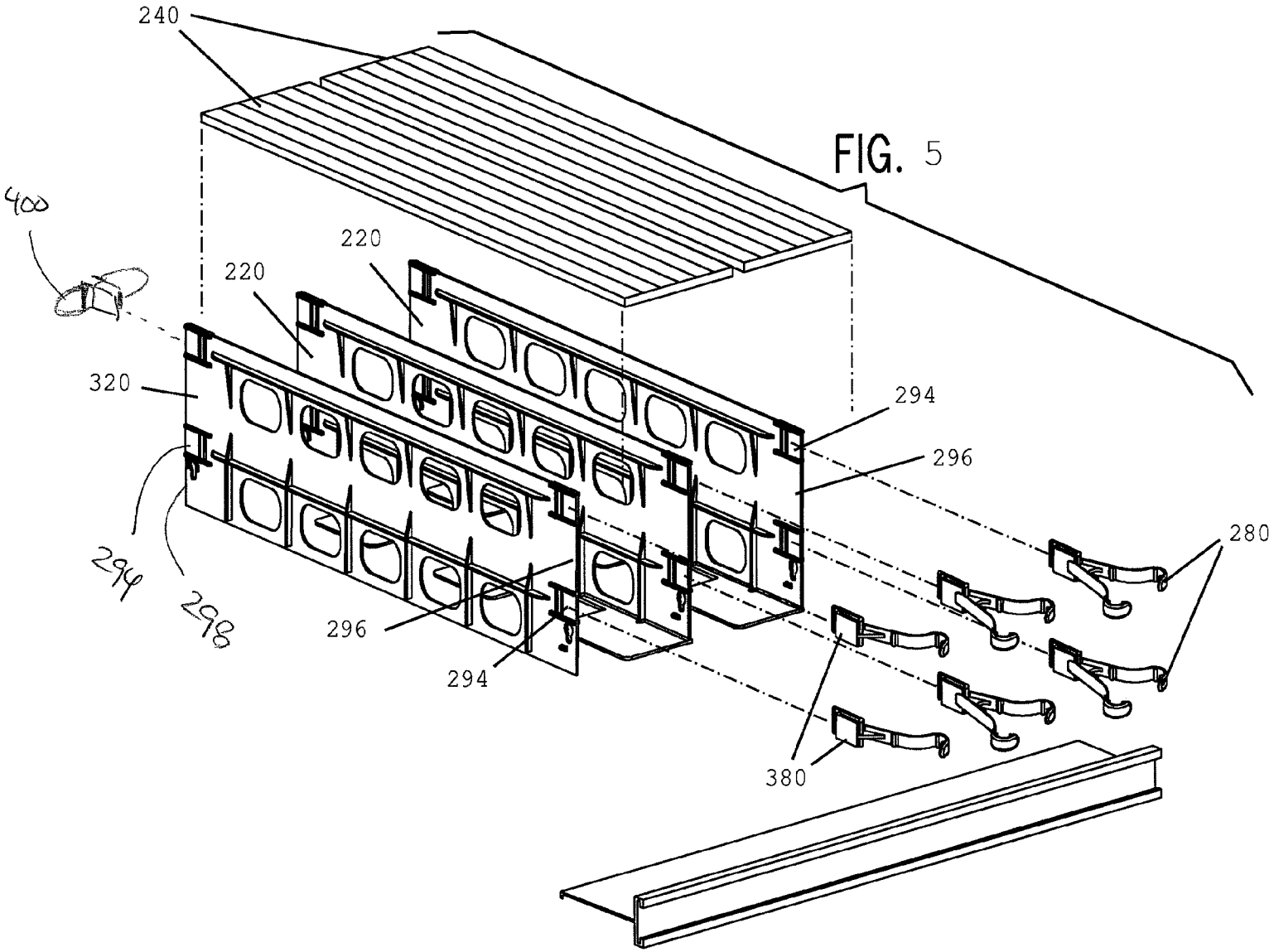
FIG. 5 is a front perspective exploded view of the shelf portion of FIG. 3 with a single rear loading gate exploded from a rear end of a divider.
Figure 6:
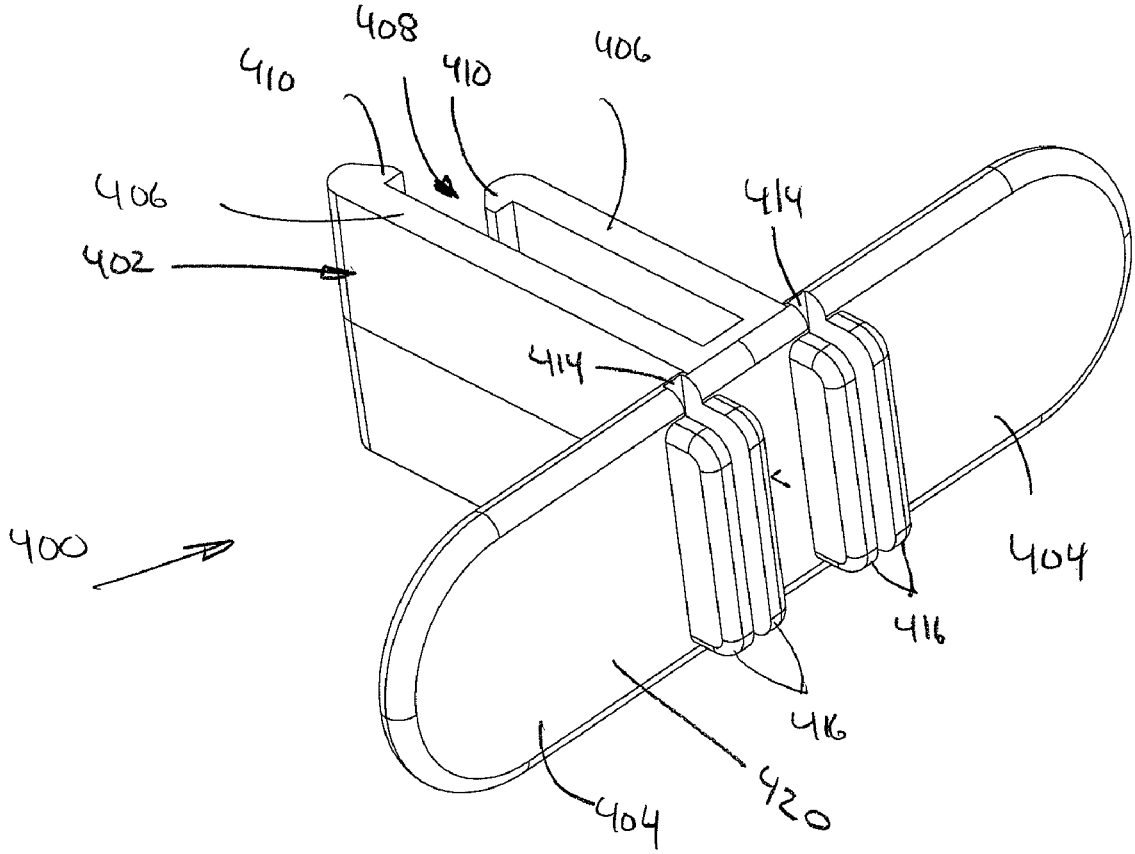
FIG. 6 is a rear perspective view of a rear loading gate of the shelf portion of FIG. 3.
Figure 7:
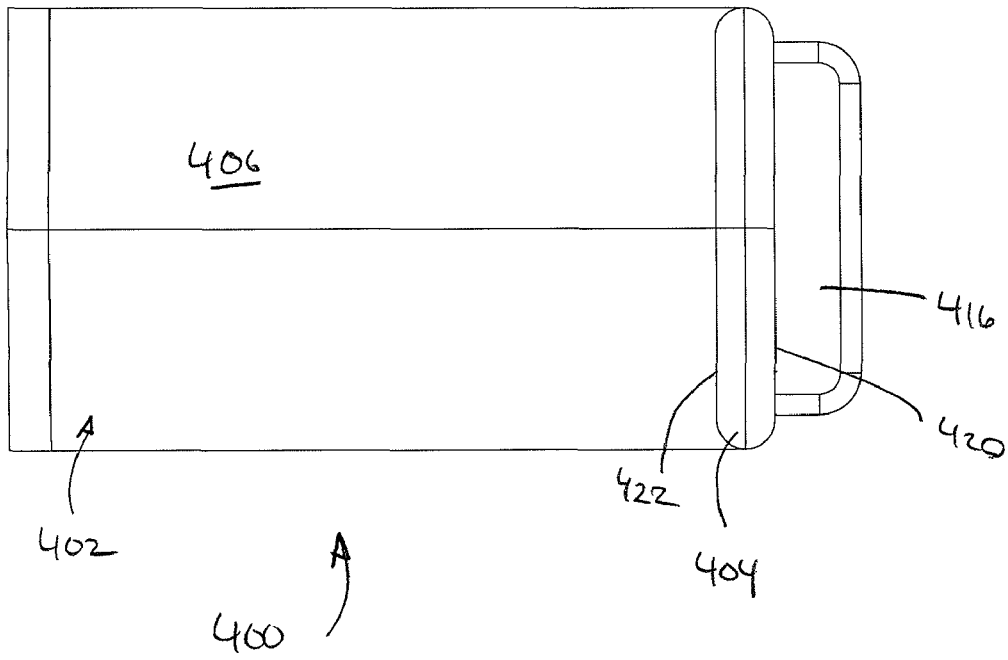
FIG. 7 is a first side view of the rear loading gate of FIG. 6.
Figure 8:
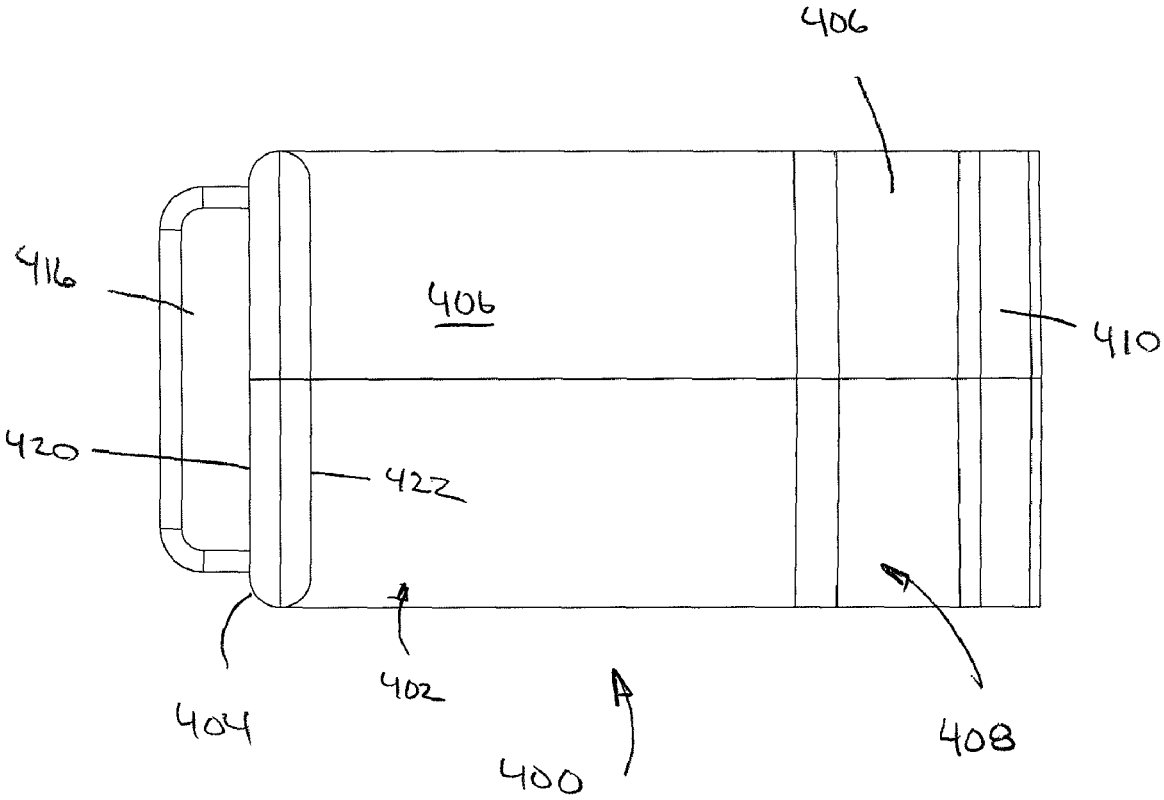
FIG. 8 is a second side view of the rear loading gate of FIG. 6.
Figure 9:
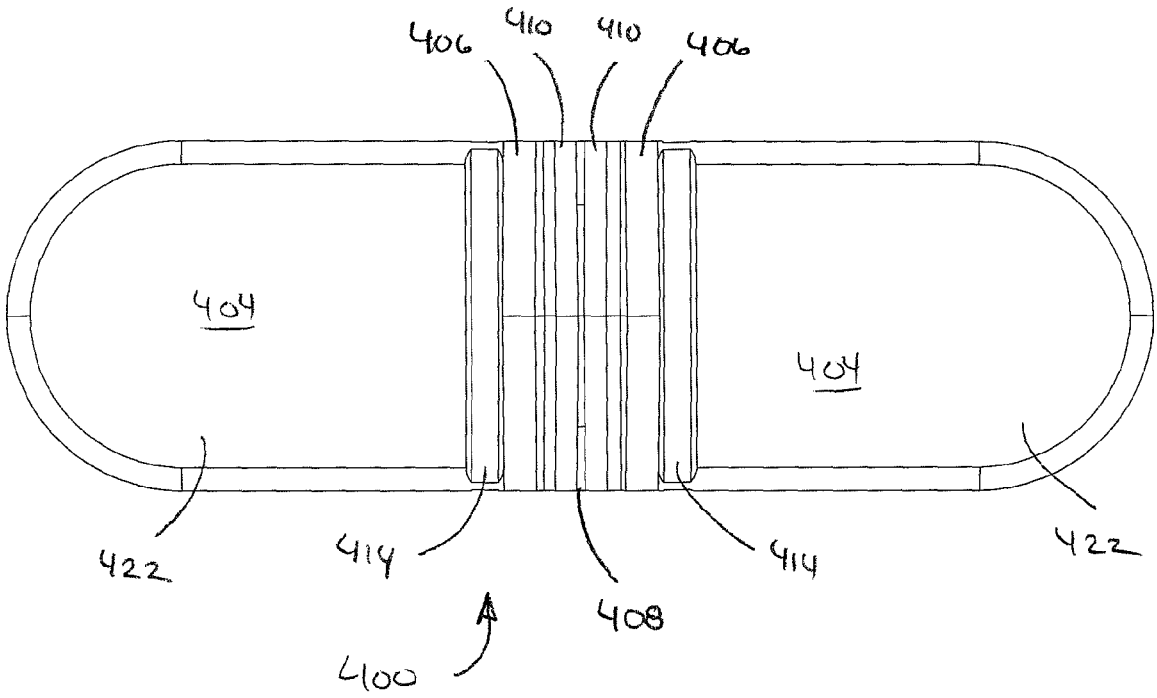
FIG. 9 is a front view of the rear loading gate of FIG. 6.

At a front end 296 of each divider 220 and 320, a pair of product retaining members are mounted. For dividers which define an outer wall without an adjacent space 222, single sided product retaining members 380 may be mounted and for the interior dividers, double sided product retaining members 280 may be mounted. These product retaining members may cooperate with a product stop 86 of a display portion 70 adjacent lip 248 to prevent product containers 290 from sliding out of spaces 22 and presenting the forwardmost containers to customers. This arrangement can also be seen in FIG. 3.

Along a rear end 298 of each divider 220 and 320 are mounted a pair of rear loading gates 400. Rear loading gates 400 cooperate with each other to permit containers 290 to be loaded into spaces 222 between rear ends 298 of the dividers. As will be shown in the FIGURES and described below, gates 400 are configured to prevent containers 290 from being pushed out of spaces 222 if spaces 222 are being loaded from the front.

Each product retaining member 280 and 380 mounts to front end 296 of dividers 220 and 320 by engaging a channel 294. A rear portion 302 of each product retaining member defines a slot for engaging the channels 294 and securing the members to the front of each space 222. A pair of channels 294 are defined opposite one another on front end 296 and each channel 294 may include a groove 292 to engage a catch or other retaining feature of rear portions 302.

Further channels 294 are defined on rear end 298 of dividers 220 and 320 to receive and mount rear loading gates 400. These rear channels 294 may be similarly configured to channels 294 along front end 296, with groove 292 provided to engage a catch or other retaining feature rear loading gates 400.

Referring now to FIGS. 6 to 11, rear loading gate 400 includes a front portion 402 and a pair of laterally extending wings 404. As shown in FIG. 2, wings 404 are sized to extend at least partially across space 222 adjacent rear end 298 of dividers 220 and 320. Gates 400 of adjacent dividers cooperate to limit access into or out of space 222. The gap or spring between the wings 404 would obviously depend on the width of the particularly product storage space 222. It is preferable that wings 404 of adjacent gates 400 be sized to not overlap. Thus, it is desirable that wings 404 be sized to extend not to or beyond halfway across space 222. The gap or spacing between the wings 404 would obviously vary based on the width of the particular product storage space 222.

Front portion 402 includes a catch for engaging and releasably mating with channel 294 of rear end 298 of dividers 220 and 320. Front portion 402 includes a pair of opposing members 406 defining a slot 408 which is sized to receive and engage channel 294 of rear end 298 of dividers 220 and 320. At an outer end of each member 406 is a snap portion or catch 410. Catch 410 is sized and positioned to engage groove 292 within channel 294. Engagement of catches 410 and grooves 292 removably secures rear loading gate 400 to divider 220 or 320. Rear loading gate 400 may be changed to a differently configured retaining member as the nature, size and weight of the product to be stored and displayed within space 222 is changed. The opposing members 406 defining slot 408 may be configured with one member 406 longer than the other, so that catches 410 are offset from each other. It is anticipated that arms of the same length and/or catches which are not offset from each other may be incorporated into a rear loading gate according to the present disclosure.

Figure 10:
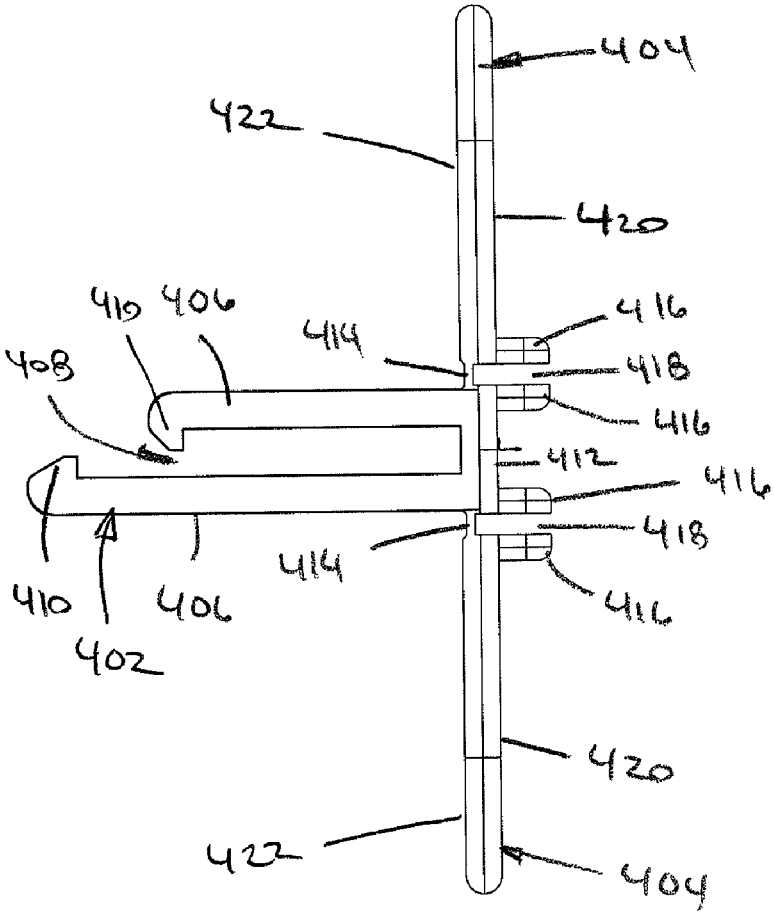
FIG. 10 is a top view of the rear loading gate of FIG. 6.
Figure 11:
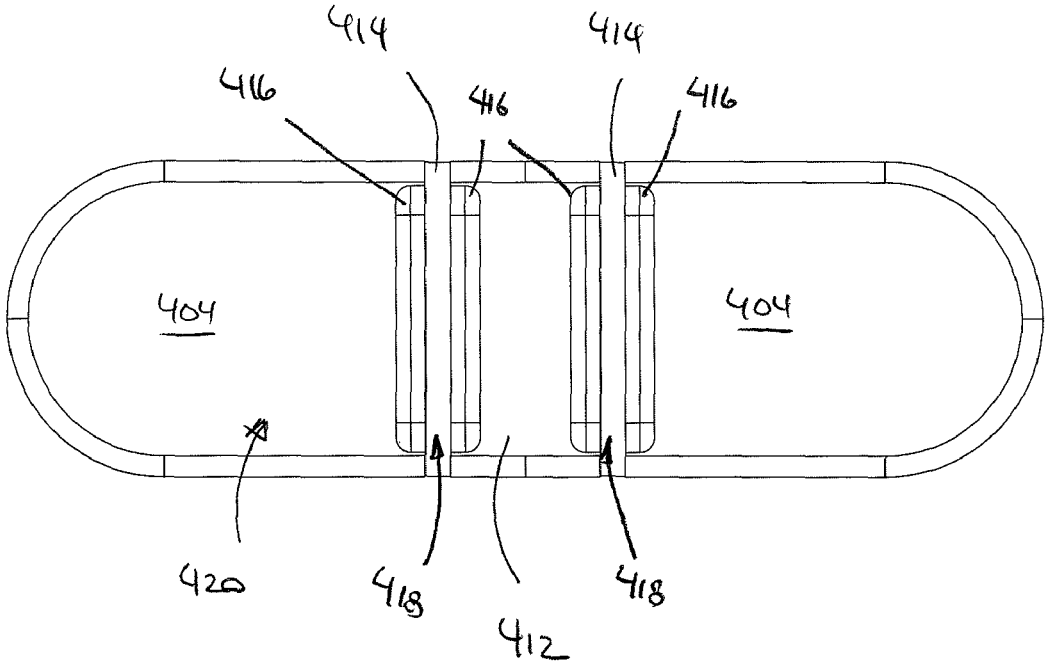
FIG. 11 is a rear view of the rear loading gate of FIG. 6.

Referring now to FIGS. 10 and 11, rear loading gate 400 may include a center section 412 between wings 404. On either side of center section 412 are a pair of hinges 414 by which wings 404 are hingedly connected to gate 400. A pair of bulkheads 416 flank each hinge 414 on a rear face 420 of gate 400. Each pair of bulkheads 416 define a gap 418 therebetween. So configured, wings 404 may be depressed forward when containers 290 are inserted past a pair of adjacent gates 400 into space 222. Hinges 414 permit gates 400 to deflect sufficiently to allow passage of containers 290 into space 222 between the adjacent gates. Thus rear loading of space 222 is enabled by gates 400.

If space 222 is front loaded, with containers 290 being inserted past product retaining members 280 and 380 through front ends 296 of dividers 220 and 320, overfilling of space 222 may result in containers 290 being pressed against a forward face 422 of each wing 404 of a pair of adjacent gates 400. However, when wings 404 are deflected rearward by the containers, bulkheads 416 on either side of each hinge 414 are deflected toward each other. Once the deflection is sufficient to close gap 418, the paired bulkheads 416 come into contact with each other, thus preventing further deflection of wings 404 rearward. The size of bulkheads 416 and the spacing between them in gap 418 are selected to stop rearward deflection of wings 404 before wings 404 are deflected sufficiently to allow a container 290 to pass between them and out of space 222 between rear ends 298 of the dividers. It is anticipated within the scope of the present disclosure that bulkheads 416 may be sized and configured to not define a distinct gap 418 and be generally in contact with each in a normal or undeflected position such as shown in FIGS. 6 to 11.

As shown hinges 414 may be living hinges and formed integrally with the remainder of gate 400. Alternatively, hinges 414 may be separate pieces or elements incorporated into gate 400. Hinges 414 should be sufficiently strong to resist deformation other than hingedly flexing under normal container sizes and weights. Similarly, bulkheads 416 and wings 404 should be sufficiently strong to resist deformation under the expected weight and size of containers 290 with space 222 and retain containers 290 within space 222.

It is anticipated that a single bulkhead 416 may be configured with only a single element on the wing side of hinge 414 and extend across the hinge toward center section 412. Such an alternative bulkhead and center section 412 would engage each other as a container 290 is pushed against front face 422 and prevent further deflection of the wing 404. As a further alternative, the bulkhead may be part of center section 412 and rear face 420 of wing 404 may be configured to engage the bulkhead when the wing is deflected rearward.

It is further anticipated that alternative arrangements of front portion 402 of gate 400 may be incorporated to engage different configurations of channel 294 and grooves 292 and hold gate 400 to the dividers. Sides 406 may be configured to have the same length, different arrangements of catches 410 may be included, and other variations are within the scope of the present disclosure. While front and rear faces 422 and 420, respectively, are shown as generally planar surfaces, it is anticipated that different shapes corresponding the containers 290 may be used, or that different textures or surface treatments may be incorporated. For example, a smoother, lower friction surface may be desirable on rear face 420 to ease entry of containers 290 into space 222, or a higher friction surface may be included on front face 422 to resist movement of containers 290 across the face and help hold the containers within space 222.

It is also important to note that the construction and arrangement of the elements of the merchandising system as shown in the exemplary embodiments is illustrative only. Although only a few embodiments of the present inventions have been described in detail, those skilled in the art will readily appreciate that many modifications are possible (e.g., variations in sizes, dimensions, structures, shapes, tolerances, and proportions of the various elements, values of parameters, mounting arrangements, use of materials, colors, orientations, etc.) without materially departing from the novel teachings and advantages of the subject matter of the present inventions. For example, elements shown as integrally formed may be constructed of multiple parts or elements show as multiple parts may be integrally formed. For example, a connector or connector portion of any of the exemplary or alternative embodiments could be made as an integral piece with a divider. The operation of the connection between the divider and connector may be reversed or otherwise varied, the shape or size (e.g., length or width) of the dividers or other elements of the system (e.g., shelf divider or interface of the divider members) may be varied, the nature or number of discrete adjustment positions provided on the connectors may be varied (e.g., by variations in the number of engagement points or size of the engagement points or type of engagement).

It should be noted that the elements and/or assemblies of the system may be constructed from any of a wide variety of materials that provide sufficient strength or durability, including any of a wide variety of moldable or extrudable plastic materials (such as high-impact plastic) in any of a wide variety of colors, textures and combinations. It should also be noted that the merchandising system may be used in association with a shelf (e.g., of a shelving unit or the like) or any of a wide variety of other surfaces in any of a wide variety of other applications. Accordingly, all such modifications are intended to be included within the scope of the present inventions.

The merchandising system may be to display and merchandise a variety of products, including containers, packages, bags, boxes, tubes, etc. The products may be food products, foodstuffs, snacks, prepared food packages, etc. Alternatively, other products of a variety of sizes and weights may be displayed and merchandised, such as consumer products, parts, batteries, automotive batteries, tissue boxes, etc.

While the invention has been described with reference to preferred embodiments, it is to be understood that the invention is not intended to be limited to the specific embodiments set forth above. Thus, it is recognized that those skilled in the art will appreciate that certain substitutions, alterations, modifications, and omissions may be made without departing from the spirit or intent of the invention. Accordingly, the foregoing description is meant to be exemplary only, the invention is to be taken as including all reasonable equivalents to the subject matter of the invention, and should not limit the scope of the invention set forth in the following claims.

What is claimed is:

1. A merchandising system comprising;

a shelf and a pair of opposing dividers, the shelf and the divider defining a space within which a plurality of product containers may be received and configured to display a forwardmost product within the space to a customer adjacent a front end of the dividers, at least one divider having a rear end with a rear loading gate mounted to the divider;

each rear loading gate comprising:

a front portion configured to releasably engage the rear end of the divider;

a central portion rearward of the front portion with a pair of opposing wings extending generally laterally from the central portion such that each wing extends less than halfway across the space between the dividers, the wings of each loading gate extending across the space;

each wing hingedly attached to the central portion and including a rearward extending bulkhead;

the bulkhead of each wing configured to engage the central portion when the wing is deflected rearward to prevent a product container within the space from passing beyond the wing and out of the space past the rear end of the dividers; and each wing configured to deflect forward into the space permitting a product container to be inserted into the space between the rear end of the dividers.

2. The merchandising system of claim 1, further comprising a plurality of dividers extending generally parallel to each other and similarly configured first pair of dividers, each divider cooperating with adjacent dividers to define a space between the dividers to receive product containers, each divider including a similarly configured rear loading gate mounted to the rear end of the divider.

3. The merchandising system of claim 1, wherein the wings of each rear loading gate hingedly connected to the central portion by a living hinge.

4. The merchandising system of claim 1, wherein the forward portion of the rear loading gate includes a pair of opposing arms defining a forward facing slot, the rear end of each divider including a channel sized to receive and engage the slot of the rear loading gate.

5. The merchandising system of claim 4, wherein each opposing arm of the forward portion of the rear loading gate includes a catch extending into the slot, the channel of the rear end of the divider further comprising a groove positioned to receive and engage the catches of the opposing arms of the rear loading gate.

6. The merchandising system of claim 5, wherein the opposing arms of each forward portion are or different lengths and the catches of the opposing arms are offset from each other.

7. The merchandising system of claim 1, further comprising the central portion including a bulkhead extending from a rear surface of the rear loading gate adjacent the hinge of each wing, each bulkhead of the central portion paired with the bulkhead of the wing adjacent the same hinge, the paired bulkheads adjacent each hinge cooperating to prevent rearward deflection of the wing.

8. The merchandising system of claim 7, wherein the paired bulkheads adjacent each hinge define a space therebetween.

9. A rear loading gate for a merchandising system, the merchandising system including a pair of dividers spaced apart and defining a space for receiving a plurality of product containers, the rear loading gate comprising:

a front portion including a pair of opposing arms defining a slot therebetween, the slot configured to receive a rear end of one of the dividers, each arm including a catch extending into the slot and configured to engage the rear end of the divider;

a central portion rearward of the forward portion with a pair of laterally extending wings connected to either side of the central portion by hinges, the wings each having a rear face and a front face, the central portion including a rear face, each wing extending less than halfway across the space between the dividers, with the hinge permitting deflection of the wing forward and rearward; and adjacent each hinge, the rear face of the wing including a rearward extending bulkhead, the bulkhead adjacent each hinge configured to engage the central portion when the wing is deflected rearward to prevent the wing from deflected rearward enough to permit a product container to pass.

10. The rear loading gate of claim 9, wherein the hinges are live hinges.

11. The rear loading gate of claim 9, further comprising a rearward extending bulkhead on the rear face of the central portion adjacent each of the hinges and paired with the bulkhead of the wing adjacent the hinge, the bulkhead of the wing engaging its paired bulkhead when the wing is deflected rearward.

12. The rear loading gate of claim 11, wherein the paired bulkheads adjacent each hinge define a slot therebetween.

* * * * *